US010301735B2

(12) United States Patent
Yanagimoto et al.

(10) Patent No.: US 10,301,735 B2
(45) Date of Patent: May 28, 2019

(54) METHOD OF FORMING METAL COATING

(71) Applicant: TOYOTA JIDOSHA KABUSHIKI KAISHA, Toyota-shi, Aichi-ken (JP)

(72) Inventors: Hiroshi Yanagimoto, Miyoshi (JP); Motoki Hiraoka, Toyota (JP); Yuki Sato, Nagakute (JP); Yoshitaka Shinmei, Nagoya (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 15/118,327

(22) PCT Filed: Feb. 9, 2015

(86) PCT No.: PCT/IB2015/000119
§ 371 (c)(1),
(2) Date: Aug. 11, 2016

(87) PCT Pub. No.: WO2015/121727
PCT Pub. Date: Aug. 20, 2015

(65) Prior Publication Data

US 2017/0175281 A1 Jun. 22, 2017

(30) Foreign Application Priority Data

Feb. 14, 2014 (JP) ..... 2014-026635

(51) Int. Cl.
*C25D 5/18* (2006.01)
*C25D 3/00* (2006.01)
(Continued)

(52) U.S. Cl.
CPC ..... *C25D 5/18* (2013.01); *C25D 3/00* (2013.01); *C25D 5/02* (2013.01); *C25D 5/06* (2013.01);
(Continued)

(58) Field of Classification Search
CPC ..... C25D 5/18
See application file for complete search history.

(56) References Cited

U.S. PATENT DOCUMENTS 4,326,930 A 4/1982 Nagel et al.
6,368,965 B1 * 4/2002 Lopatin ..... H01L 21/2885 257/E21.175
(Continued)

FOREIGN PATENT DOCUMENTS

JP 01-165786 A 6/1989
JP 2003-124214 A 4/2003
(Continued)

OTHER PUBLICATIONS

Lou et al., in Encyclopedia of Chemical Processing, Taylor and Francis: New York (2007).*
(Continued)

*Primary Examiner* — Bryan D. Ripa
(74) *Attorney, Agent, or Firm* — Sughrue Mion, PLLC

(57) ABSTRACT

A method of forming a metal coating includes: disposing a solid electrolyte membrane (13) between an anode (11) and a substrate (B) which forms a cathode; bringing a solution (L) containing metal ions into contact with an anode-side portion of the solid electrolyte membrane (13); and causing, in a state where the solid electrolyte membrane (13) is in contact with the substrate (B), a current to flow from the anode (11) to the cathode so as to form a metal coating formed of the metal on the surface of the substrate (B). The metal coating is formed by repeating a current-flowing period (T) in which a current flows from the anode (11) to the cathode and a non-current-flowing period (N) in which a current does not flow between the anode (11) and the cathode.

1 Claim, 13 Drawing Sheets

(51) Int. Cl.

| | |
|---|---|
| ***C25D 5/02*** | (2006.01) |
| ***C25D 5/06*** | (2006.01) |
| ***C25D 17/14*** | (2006.01) |
| *C25D 3/12* | (2006.01) |
| *C25D 5/12* | (2006.01) |
| *C25D 17/00* | (2006.01) |
| *C25D 17/12* | (2006.01) |

(52) U.S. Cl.
CPC ..... *C25D 17/14* (2013.01); *C25D 3/12* (2013.01); *C25D 5/12* (2013.01); *C25D 17/001* (2013.01); *C25D 17/12* (2013.01)

(56) References Cited

U.S. PATENT DOCUMENTS 7,998,323 B1 * 8/2011 Chandra ..... C25D 5/22 204/224 M
2008/0217182 A1 9/2008 Dai
2015/0014178 A1 * 1/2015 Hiraoka ..... C25D 5/08 205/261

FOREIGN PATENT DOCUMENTS

JP 2010-037622 A 2/2010
JP 2012-219362 A 11/2012
JP WO 2013125643 A1 * 8/2013 ..... C25D 5/08
WO 2013/125643 A1 8/2013

OTHER PUBLICATIONS

Shao Ligeng et al: Development of nanocrystalline nickel by pulse reverse microelectroforming, Micro and Nano Letters, The Institution of Engineering and Technology, GB vol. 5, No. 3, Jun. 30, 2010 (Jun. 30, 2010), pp. 165-170, XP006035707, ISSN: 1750-0443, DOI: 10.1049/MNL:20100037 figure 1 section 4. Conclusions.

* cited by examiner

METHOD OF FORMING METAL COATING

BACKGROUND OF THE INVENTION

1. Field of the Invention

The present invention relates to a method of forming a metal coating and particularly to a method of forming a metal coating capable of suitably forming a metal coating using a solid electrolyte membrane.

2. Description of Related Art

When an electronic circuit substrate or the like is manufactured, a metal coating is formed on a surface of the substrate so as to form a metal circuit pattern thereon. For example, as a technique of forming such a metal coating, a technique (Japanese Patent Application Publication No. 2010-037622 (JP 2010-037622 A)) of forming a metal coating on a surface of a semiconductor substrate of Si or the like by plating such as electroless plating; and a technique of forming a metal coating using a PVD method such as sputtering are disclosed.

However, when plating such as electroless plating is performed, a washing process is necessary after the plating, and a process of treating a waste liquid used during the washing process is also necessary. In addition, when a metal coating is formed on a surface of a substrate using a PVD method such as sputtering, internal stress is generated in the formed metal coating. Therefore, the PVD method has a limit in increasing the thickness of a metal coating, and particularly in the case of sputtering, a metal coating can be formed only in a high vacuum environment.

From this point of view, for example, a coating forming device 6 illustrated in FIG. 10A is disclosed, the coating forming device 6 including at least: an anode 61 that is formed of a porous body; a solid electrolyte membrane 63 that is disposed between the anode 61 and a substrate B, which forms a cathode, such that a solution L containing metal ions is in contact with a portion of the solid electrolyte membrane 63 on the anode 61 side; and a power supply 64 that applies a voltage between the anode 61 and the substrate B (for example, JP 2010-037622 A). Here, in a housing 65 of the coating forming device 6, a storage 69 in which the solution L containing the metal ions is stored is formed, and the anode 61 and the solid electrolyte membrane 63 are disposed such that the solution L containing the metal ions in the storage 69 can be supplied to the solid electrolyte membrane 63 through the anode 61.

Using this coating forming device 6, the power supply 64 applies a voltage between the anode 61 and the substrate B, and metal is deposited on a surface of the substrate B from the metal ions contained in the solid electrolyte membrane 63. As a result, a metal coating F formed of the metal is formed on the surface of the substrate B.

When the device illustrated in FIG. 10A is used, the size and shape of the anode 61 are set according to a coating-forming region (deposition range) of the substrate B. However, as illustrated in FIG. 10B, the metal ions in the solid electrolyte membrane 63 are radially diffused in a width direction of the solid electrolyte membrane 63 as well as a thickness direction thereof.

At this time, during coating formation, a portion of the metal ions diffused to the outside of an edge 61*a* of the anode 61 (specifically, the metal ions diffused in a direction S2 of FIG. 10B) is returned to and deposited on the coating-forming region along with movement of an electrical charge in the thickness direction (direction S1 of FIG. 10B) of the solid electrolyte membrane 63.

However, the remaining portion of the metal ions may be deposited on a non-coating-forming region (non-deposition region) on which the formation of a metal coating is not desirable. As a result, a metal coating having a desired pattern shape may not be formed. Further, when metal is deposited on the non-coating-forming region, an electric charge which is supposed to be consumed in the coating-forming region is consumed in the non-coating-forming region, which may lead to a decrease in the coating-forming rate.

From this point of view, a technique of masking a non-coating-forming region of the substrate B, which is generally to be subjected to wet plating, with a masking material 40 as illustrated in FIG. 10C is also considered one of the countermeasures against the decrease in the coating-forming rate.

However, the masking material 40 is thick, and thus when the solid electrolyte membrane 63 is brought into contact with the substrate B using a device illustrated in FIG. 10C, a portion of the coating-forming region near an edge D is in the non-contact state. Accordingly, metal is not deposited on the edge of the coating-forming region which is in the non-contact state. As a result, a metal coating having a desired pattern shape may not be formed.

SUMMARY OF THE INVENTION

The invention has been made to provide a method of forming a metal coating capable of forming a metal coating having a desired pattern shape to thereby suppress a decrease in the coating-forming rate.

As a result of thorough investigation, the present inventors thought that, when a current is caused to continuously flow during coating formation, a small amount of current flows to a non-coating-forming region, and thus metal is deposited on the non-coating-forming region. The present inventors have obtained a new finding that, when one metal coating is formed, the flow of a current to a non-coating-forming region can be reduced by causing a current to intermittently flow in multiple times.

The invention is based on the above-described findings. According to an aspect of the invention, there is provided a method of forming a metal coating including: disposing a solid electrolyte membrane between an anode and a substrate which forms a cathode; bringing a solution containing metal ions into contact with an anode-side portion of the solid electrolyte membrane; and causing, in a state where the solid electrolyte membrane is in contact with the substrate, a current to flow from the anode to the cathode such that metal is deposited on a surface of the substrate from the metal ions contained in the solid electrolyte membrane to form a metal coating formed of the metal on the surface of the substrate. The metal coating is formed by repeating a first current-flowing period in which a current flows from the anode to the cathode and a non-current-flowing period in which a current does not flow between the anode and the cathode.

According to the invention, the solution containing metal ion is brought into contact with the anode-side surface of the solid electrolyte membrane, and in a state where the solid electrolyte membrane is in contact with the substrate, a current is caused to flow from the anode to the cathode (that is, the substrate) in the first current-flowing period. As a result, metal can be deposited on the surface of the substrate from the metal ions contained in the solid electrolyte membrane. Thus, a metal coating formed of the metal can be formed on the surface of the substrate.

According to the invention, the non-current-flowing period in which a current does not flow between the anode and the cathode is provided between the first current-flowing period and the subsequent first current-flowing period, and thus a current is caused to intermittently flow from the anode to the cathode. Therefore, the flow of a current to a non-coating-forming region can be suppressed. As a result, a metal coating having a desired pattern shape can be formed, and thus a decrease in the coating-forming rate can be suppressed.

In addition, when a current is caused to flow, the diffusion of metal ions is delayed relative to the deposition of metal which forms a metal coating. Therefore, the thickness of a portion where the metal ions are consumed (portion where the metal ions are to be diffused) increases. However, according to the invention, in the non-current-flowing period, a portion of the solid electrolyte membrane where the metal ions are consumed to form a metal coating can be replenished with the metal ions by diffusing the metal ions therein from the solution containing the metal ions which is in contact with the anode-side portion of the solid electrolyte membrane. According to the invention, a metal coating can be formed by repeatedly causing a current, which is higher than the flowing current of an ordinary coating formation, to flow in the first current-flowing period. As a result, a metal coating having a dense and fine crystal structure can be obtained.

As long as the first current-flowing period and the non-current-flowing period can be repeated, a current waveform to be used may be a triangular, sinusoidal, or sawtooth waveform, a stepwise waveform which is generated when the current- density increases or decreases stepwise, or a current waveform including a combination of waveforms having plural shapes. In addition, these current waveforms may be periodic.

A current waveform including the first current-flowing period and the non-current-flowing period may be formed of a rectangular current waveform. By causing a current formed of a rectangular waveform such as a pulse current to flow in the first current-flowing period, the current in the first current-flowing period can be made to rapidly rise and fall. As a result, in a falling period of the current of the first current-flowing period, the movement of the metal ions in the solid electrolyte membrane to the cathode-side portion which is caused by metal deposition can be rapidly inhibited. As a result, the first current-flowing period can be rapidly shifted to the non-current-flowing period. Therefore, the solid electrolyte membrane can be rapidly replenished with the metal ions when the metal ions are consumed in the cathode-side portion, and the coating-forming rate can be improved.

In addition, as long as a metal coating can be formed (metal can be deposited) in the first current-flowing period, and as long as the solid electrolyte membrane can be replenished with the metal ions in the non-current-flowing period, the first current-flowing period may be continuously shifted to the non-current-flowing period.

The first current-flowing period may be shifted to the non-current-flowing period after causing, in a second current-flowing period which is shorter than the first current-flowing period, a current to flow from the cathode to the anode. With such a configuration, when the first current-flowing period is shifted to the non-current-flowing period, a current in the current-flowing period can be made to rapidly fall, and the movement of the metal ions in the solid electrolyte membrane to the cathode-side portion during metal deposition can be rapidly inhibited. Further, since a current is caused to flow from the cathode to the anode, metal on the surface of the metal coating is dissolved as metal ions. Accordingly, impurities which are likely to be incorporated into the surface of the metal coating immediately after the finish of the current-flowing period can be reduced in the surface of the metal coating.

According to the invention, a metal coating having a desired pattern shape can be formed, and thus a decrease in the coating-forming rate can be suppressed.

BRIEF DESCRIPTION OF THE DRAWINGS

Features, advantages, and technical and industrial significance of exemplary embodiments of the invention Will be described below with reference to the accompanying drawings, in which like numerals denote like elements, and wherein.

DETAILED DESCRIPTION OF EMBODIMENTS

Methods of forming a metal coating according to two embodiments of the invention will be described below.

[First Embodiment]

Figure 1:
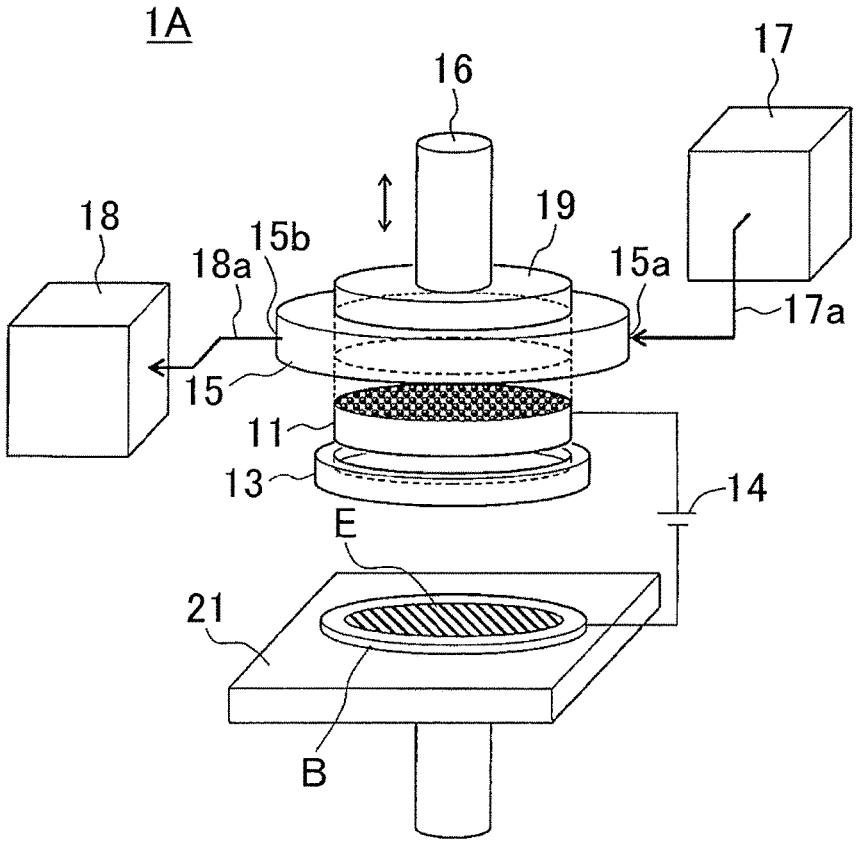
FIG. 1 is a schematic diagram illustrating a coating forming device for suitably performing a method of forming a metal coating according to a first embodiment of the invention.
Figure 2:
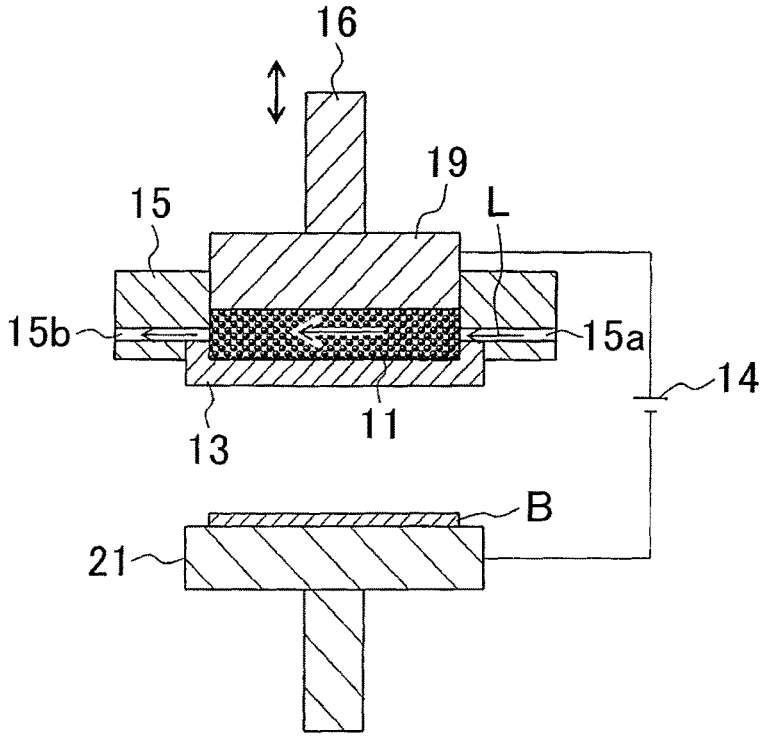
FIG. 2 is a schematic cross-sectional view illustrating the coating forming device illustrated in FIG. 1.

FIG. 1 is a schematic diagram illustrating a coating forming device for suitably performing a method of forming a metal coating according to a first embodiment of the invention. FIG. 2 is a schematic cross-sectional view illustrating the coating forming device illustrated in FIG. 1.

As illustrated in FIG. 1, in a coating forming device 1A according to the embodiment, metal is deposited from metal ions, and a metal coating formed of the deposited metal is formed on a surface of a substrate B. Here, examples of the substrate B include a substrate formed of a metal material such as aluminum; and a substrate in which a metal underlayer is formed on a treated surface of a resin or a silicon substrate.

The coating forming device 1A includes at least: an anode 11 that is formed of metal; a solid electrolyte membrane 13 that is provided between the anode 11 and the substrate B, which forms a cathode, to be disposed on a surface of the anode 11; and a power supply 14 that applies a voltage between the anode 11 and the substrate B, which forms the cathode, to cause a current to flow from the anode. 11 to the cathode (substrate B).

The anode 11 is accommodated in a housing (metal ion supply portion) 15 that supplies a solution L (hereinafter, referred to as "metal solution") containing metal ions, which form a metal coating, to the anode 11. A penetration portion that vertically penetrates the housing 15 is formed in the housing 15, and the anode 11 is accommodated in an internal space of the penetration portion. A concave portion is formed in the solid electrolyte membrane 13 to cover a lower surface of the anode 11, and the solid electrolyte membrane 13 covers a lower-side opening of the penetration portion of the housing 15 in a state where a lower portion of the anode 11 is accommodated therein.

Further, in the penetration portion of the housing 15, a contact pressurization portion (metal punch) 19 that is in contact with an upper surface of the anode 11 to pressurize the anode 11 is disposed. The contact pressurization portion 19 causes the solid electrolyte membrane 13 to pressurize the surface of the substrate B through the anode 11. Specifically, in order to uniformly pressurize a coating-forming region E of the surface of the substrate B on which a metal coating is formed, the contact pressurization portion 19 pressurizes a portion of the surface of the anode 11 corresponding to the coating-forming region E.

The upper and lower surfaces of the anode 11 have the same size and have a surface area corresponding to the coating-forming region E. Accordingly, when the contact pressurization portion 19 pressurizes the upper surface (entire surface) of the anode 11 using a thrust of a pressurizing device 16 (described below), the lower surface (entire surface) of the anode 11 can uniformly pressurize the coating-forming region (entire region) of the substrate B through the solid electrolyte membrane 13.

Further, a solution tank 17 in which the metal solution L is stored is connected to one side of the housing 15 through a supply pipe 17*a*, and a waste liquid tank 18 in which a used waste liquid is recovered is connected to the other side of the housing 15 through a waste liquid pipe 18*a*.

The supply pipe 17*a* is connected to a supply flow path 15*a* for the metal solution L in the housing 15, and the waste liquid pipe 18*a* is connected to a discharge flow path 15*b* for the metal solution L in the housing 15. As illustrated in FIG. 2, the anode 11 formed of a porous body is disposed in a flow path that connects the supply flow path 15*a* and the discharge flow path 15*b* of the housing 15 to each other.

With such a configuration, the metal solution L stored in the solution tank 17 is supplied to the inside of the housing 15 through the supply pipe 17*a*. In the housing 15, the metal solution L passes through the supply flow path 15*a* and flows from the supply flow path 15*a* to the inside of the anode 11. The metal solution L which has been passed through the anode 11 flows through the discharge flow path 15*b* and can be sent to the waste liquid tank 18 through the waste liquid pipe 18*a*.

Further, the pressurizing device 16 is connected to the contact pressurization portion 19. The pressurizing device 16 causes the solid electrolyte membrane 13 to pressurize the coating-forming region E of the substrate B by moving the anode 11 toward the substrate B. For example, examples of the pressurizing device 16 include a hydraulic or pneumatic cylinder. The coating forming device 1A is fixed to the substrate B and includes a base 21 that adjusts the alignment of the substrate B relative to the anode 11.

The anode 11 is formed of a porous body that allows permeation of the metal solution L and supplies the metal ions to the solid electrolyte membrane. Such a porous body is not particularly limited as long as it has corrosion resistance to the metal solution L, has conductivity in which it can operate as the anode, can allow permeation of the metal solution L, and can pressurize the coating-forming region E using the pressurizing device 16 through the contact pressurization portion 19.

For example, a metal foam such as titanium foam having a lower ionization tendency than plating metal ions (or having a high electrode potential) and formed of a porous open cell foam may be used, and it is preferable that this metal foam has a porosity of approximately 50 vol % to 95 vol %, a pore size of approximately 50 μm to 600 μm, and a thickness of approximately 0.1 mm to 50 mm.

Examples of the metal solution L include an aqueous solution containing metal ions of copper, gold, silver, nickel, or the like. For example, in the case of copper ions, a solution containing copper sulfate, copper pyrophosphate, or the like may be used, and in the case of nickel ions, a solution containing nickel sulfate or the like may be used. Examples of the solid electrolyte membrane 13 include a membrane and a film formed of a solid electrolyte.

The solid electrolyte membrane 13 is not particularly limited as long as it can be brought into contact with the above-described metal solution L, the inside thereof can be impregnated with the metal ions, and metal derived from the metal ions can be deposited on the surface of the substrate B when a voltage is applied thereto. Examples of the material of the solid electrolyte membrane include fluororesin, hydrocarbon resins, and polyamic acid resins such as NATION (registered trademark) manufactured by DuPont; and resins having an ion exchange function such as SELECTIN (CMV, CMD, CMF series) manufactured by Asahi Glass Co., Ltd.

Here, in the device for forming a metal coating according to the embodiment, the anode 11 is formed of a porous body. However, as described below, the anode 11 is not limited to this device and the method using this device as long as it can impregnate the solid electrolyte membrane 13 with the metal ions.

Figure 3:
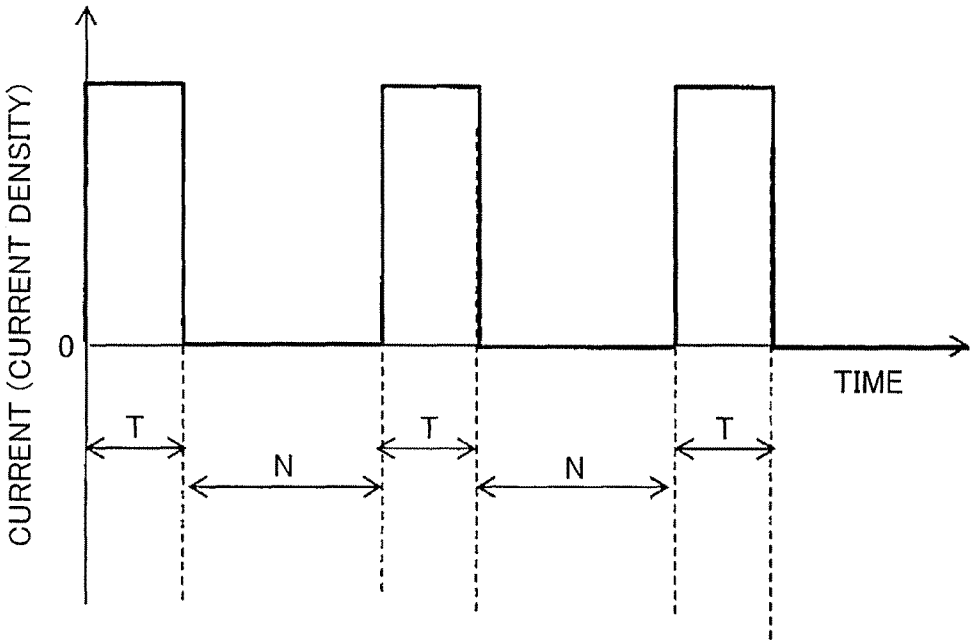
FIG. 3 is diagram illustrating a waveform of a current which is caused to flow between an anode and a cathode in the method illustrated in FIG. 1.

FIG. 3 is diagram illustrating a waveform of a current which is caused to flow between the anode 11 and the cathode (substrate B) in the method illustrated in FIG. 1. In the embodiment, as illustrated in FIG. 3, the power supply 14 can generate a current waveform such that a current-flowing period T in which a current flows from the anode 11 to the cathode (substrate B) and a non-current-flowing period N in which a current does not flow between the anode 11 and the cathode (substrate B) can be repeated.

More specifically, in the embodiment, the power supply 14 can generate a pulse current (rectangular current waveform) including a DC current, and a current waveform including the current-flowing period T and the non-current-flowing period N is formed (generated) of a rectangular current waveform. However, as described above, the power supply 14 is not limited to a power supply that generates a rectangular current waveform as in the pulse current of FIG. 3 as long as it can repeatedly set the coating forming device to be in the current-flowing period. T and the non-current-flowing period N. For example, the power supply 14 may generate a triangular, sinusoidal, or sawtooth waveform, a stepwise waveform which is generated when the current density increases or decreases stepwise, or a current waveform including a combination of waveforms having plural shapes. In addition, in the embodiment, these current waveforms are periodic but may be non-periodic.

Using this device 1A, the method of forming a metal coating according to the embodiment is performed. First, the substrate B is disposed on the base 21, the alignment of the substrate B relative to the anode 11 is adjusted, and the temperature of the substrate B is adjusted. Next, the solid electrolyte membrane 13 is disposed on the surface of the anode 11 formed of a porous body and is brought into contact with the substrate B.

Next, the pressurizing device 16 causes the solid electrolyte membrane 13 to pressurize the coating-forming region E of the substrate B by moving the anode 11 toward the substrate B. As a result, since the solid electrolyte membrane 13 can be pressurized through the anode 11, the surface of the substrate B of the coating-forming region E can be made to conform to the solid electrolyte membrane 13. That is, a metal coating having a more uniform thickness can be formed while brining the solid electrolyte membrane 13 into contact (press contact) with the substrate using the anode 11 as a back-up material.

Next, the metal ions are supplied to the anode 11 formed of a porous body to bring the solution L containing the metal ions into contact with an anode-side portion of the solid electrolyte membrane 13. Then, the power supply 14 applies a voltage between the anode 11 and the substrate B which forms the cathode to cause a current to flow from the anode 11 to the cathode (substrate B). As a result, metal is deposited on the surface of the substrate B from the metal ions contained in the solid electrolyte membrane 13.

More specifically, in the embodiment, using the pulse current (rectangular current waveform) supplied from the power supply 14, the current-flowing period T in which a current flows from the anode 11 to the substrate B, which is the cathode, and the non-current-flowing period N in which a current does not flow between the anode 11 and the substrate B are repeated. As a result, a metal coating is formed.

In this way, in the current-flowing period T in which a current flows from the anode 11 to the substrate B which is the cathode, the metal ions in the solid electrolyte membrane 13 move from the anode 11 to the substrate B, and metal is deposited on the surface of the substrate B from the metal ions contained in the solid electrolyte membrane 13. As a result, a metal coating is formed on the surface of the substrate B.

In this, way, the non-current-flowing period N in which a current does not flow between the anode 11 and the substrate B is set between the current-flowing period T and the current-flowing period T, and thus a current intermittently flows from the anode 11 to the substrate B. In this case, the current-flowing time is shorter than that of a case where a constant current is caused to continuously flow from the anode 11 to the substrate B. As a result, a current can be prevented from flowing to a non-coating-forming region, and a metal coating having a desired pattern shape can be formed. Further, since a current can be prevented from flowing to a non-coating-forming region, a decrease in metal coating-forming rate can be suppressed.

Figure 4A:
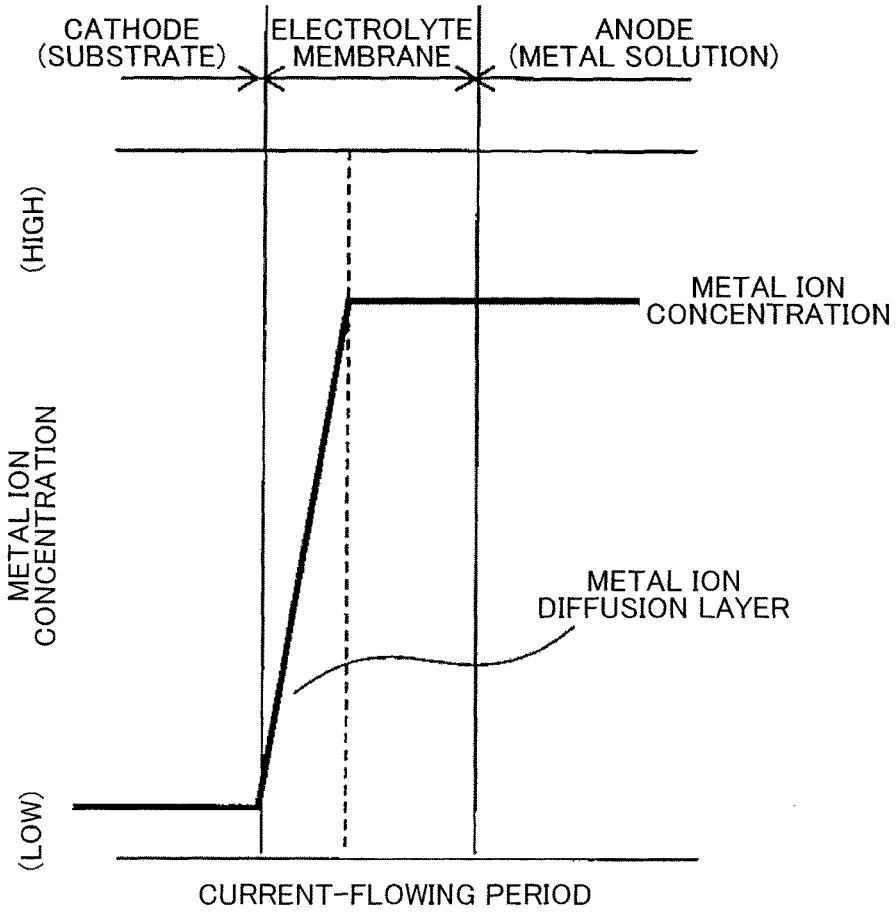
FIG. 4A is a diagram illustrating a metal ion concentration in a current-flowing period.
Figure 4B:
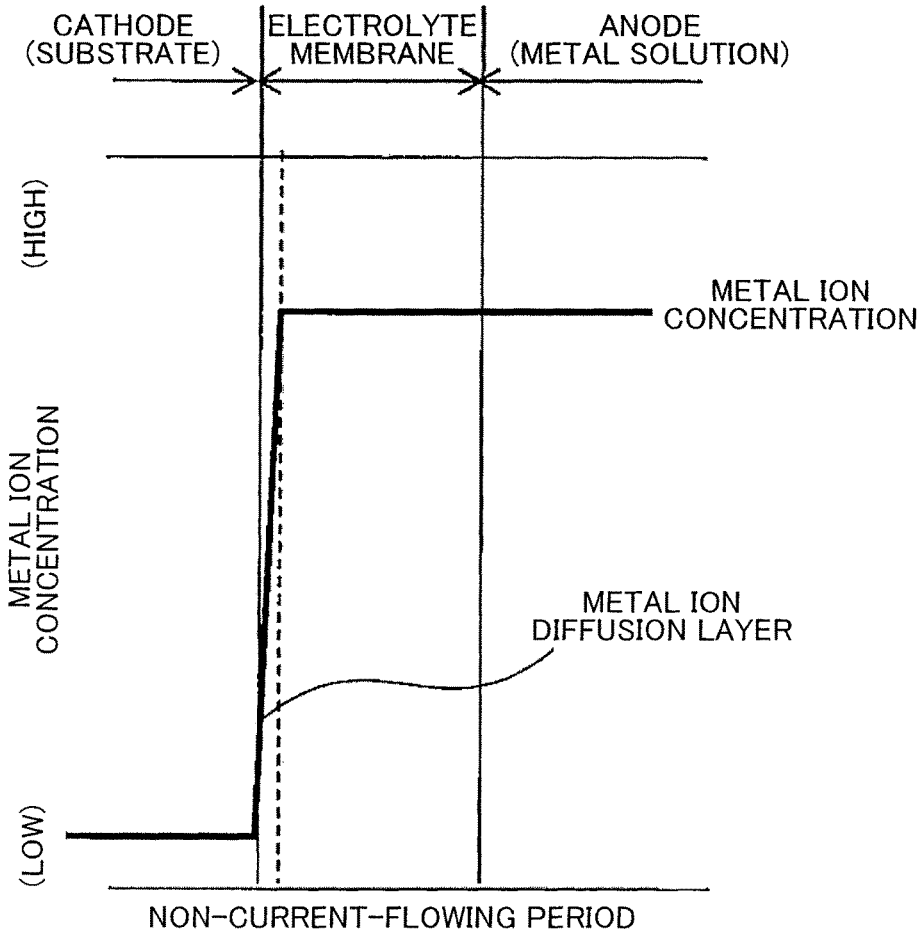
FIG. 4B is a diagram illustrating a metal ion concentration in a non-current-flowing period.
Figure 5:
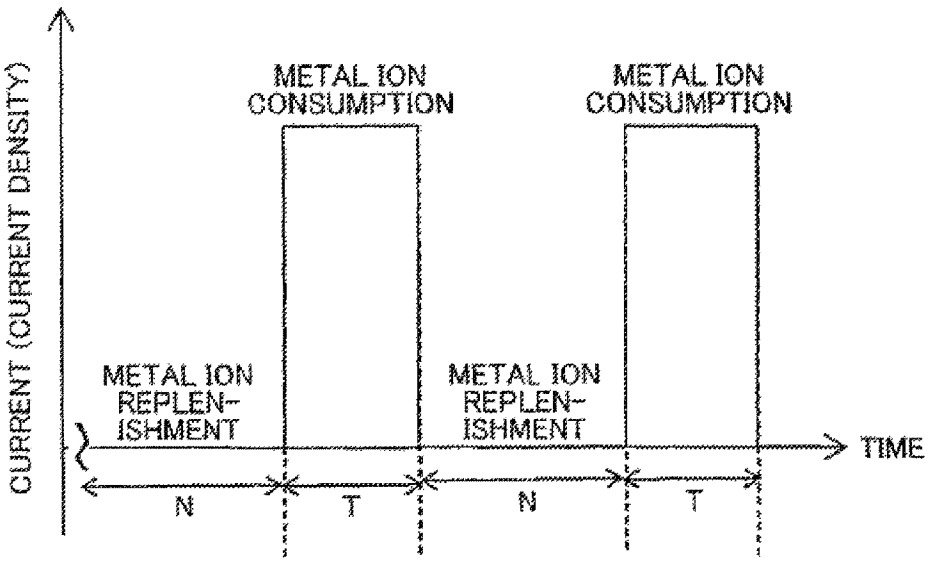
FIG. 5 is diagram illustrating a potential of the anode and a metal ion state in a solid electrolyte membrane.

FIG. 4A is a diagram illustrating a metal ion concentration in the current-flowing period T. FIG. 4B is a diagram illustrating a metal ion concentration in the non-current-flowing period N. FIG. 5 is diagram illustrating a potential of the anode and a metal ion state in the solid electrolyte membrane.

As illustrated in FIG. 4A, in the current-flowing period T, the metal ions in the solid electrolyte membrane move to the substrate, which is the cathode, and are deposited thereon. At this time, the diffusion of the metal ions to the inside of the solid electrolyte membrane is slower than the deposition of the metal. Therefore, a metal ion concentration in a cathode-side portion of the solid electrolyte membrane decreases, and the portion where the metal ion concentration decreases (that is, the portion where the metal ions are consumed) forms a diffusion layer (in the drawings, a metal ion diffusion layer) where the metal ions are to be diffused. Here, when a constant current is caused to continuously flow to form a metal coating, the thickness of the metal ion diffusion layer further increases and is fixed at a given thickness:

However, in the embodiment, the above-described non-current-flowing period. N is made to be present by using the pulse current (rectangular current waveform). Therefore, in this non-current-flowing period, the portion where the metal ions are consumed in the current-flowing period can be replenished with the metal ions from the metal solution which is in contact with the anode-side surface of the solid electrolyte membrane. As a result, as illustrated in FIG. 4B, the thickness of the metal ion diffusion layer decreases, and in the next current-flowing period T, the metal ion concentration in the vicinity the substrate positioned inside the solid electrolyte membrane can be increased.

In this way, as illustrated in FIG. 5, the metal ions in the solid electrolyte membrane are consumed in the current-flowing period T, and the solid electrolyte membrane is replenished with the metal ions in the non-current-flowing period N. As a result, in the current-flowing period, the metal ion concentration in the vicinity of the substrate is increased as illustrated in FIG. 4B. Therefore, metal can be more stably deposited, and a high-quality metal coating in which yellowing (phenomenon in which a metal oxide or a hydroxide is produced in a metal coating and the color of the metal coating is changed), non-uniformity, and the like are reduced can be formed. Further, a metal coating can be formed at a higher current than the flowing current of an ordinary coating formation, and thus a metal coating having a dense and fine crystal structure can be formed.

Further, in the embodiment, by providing the current-flowing period T and the non-current-flowing period N using the rectangular current waveform such as a pulse current, a current can be made to rapidly rise and fall in the current-flowing period T. As a result, in a falling period of the current-flowing period T, the movement of the metal ions in the solid electrolyte membrane to the cathode-side portion which is caused by metal deposition can be rapidly inhibited. As a result, the current-flowing period T can be rapidly shifted to the non-current-flowing period N. Therefore, the solid electrolyte membrane can be rapidly replenished with the metal ions when the metal ions are consumed in the cathode-side portion, and the coating-forming rate can be improved.

Figure 6:
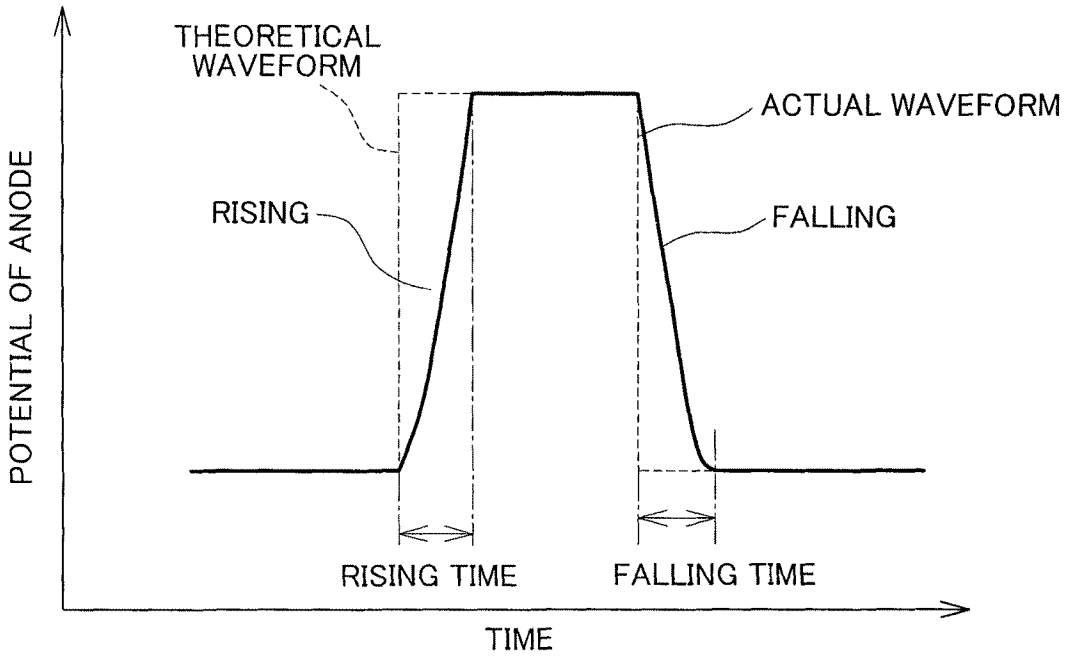
FIG. 6 is a diagram illustrating a change in the potential of the anode when a current is caused to flow according to the current waveform illustrated in FIG. 3.

FIG. 6 is a diagram illustrating a change in the potential of the anode when a current is caused to flow according to the current waveform of the first embodiment illustrated in FIG. 3. As illustrated in FIG. 6, when a pulse current is caused to flow from the anode to the cathode, a potential of the anode changes according to this pulse current. At this time, an actual waveform is delayed relative to a theoretical waveform illustrated in FIG. 6. Further, the rising time where a potential of the actual waveform rises and the-falling time where a potential of the actual waveform falls also increase relative to the theoretical waveform. In FIG. 6, the potential of the anode is illustrated. However, a relationship between a theoretical current waveform, which should be output by the power supply, and an actual current waveform, which flows from the actual anode to the substrate, is also the same as described above.

Accordingly, in the first embodiment, the metal ions moves to the cathode-side portion due to metal deposition even during the falling time. Therefore, it is preferable that the non-current-flowing period be set in consideration of the falling time. For example, it is preferable that the non-current-flowing time be set to be longer than the current-flowing time to which the rising time and the falling time are added.

[Second Embodiment]

Figure 7:
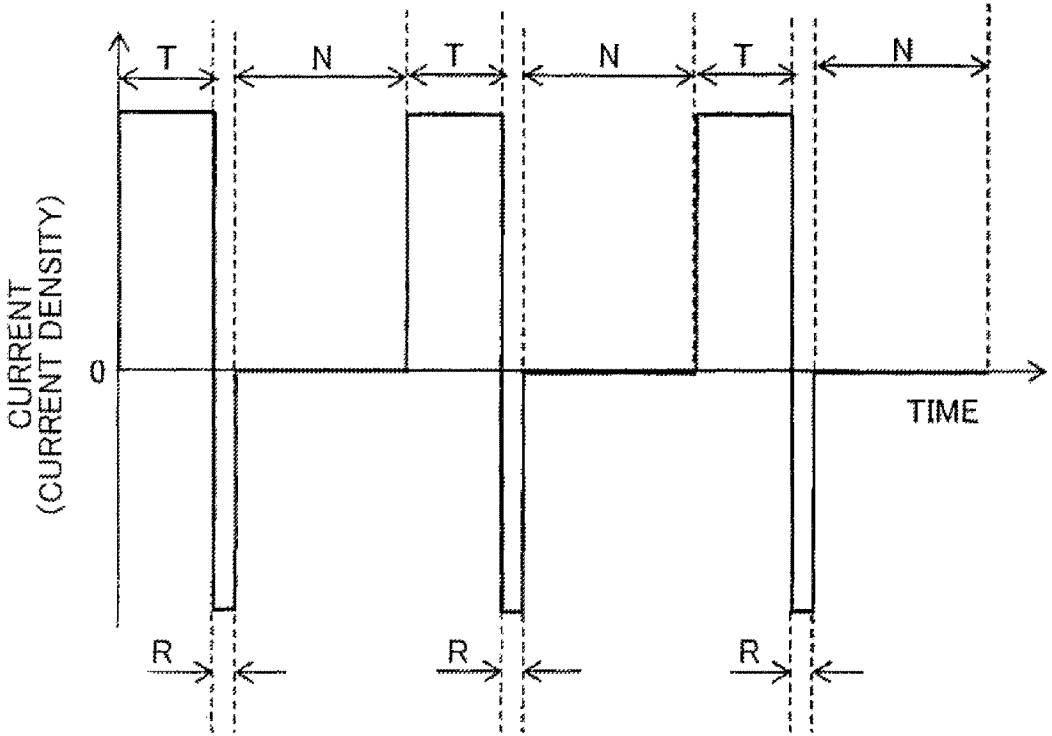
FIG. 7 is diagram illustrating a waveform of a current which is caused to flow between an anode and a cathode in a method of forming a metal coating according to a second embodiment of the invention.

A second embodiment of the invention is different from the first embodiment only in the waveform of a current which is caused to flow by the power supply. Accordingly, in the second embodiment, only different configurations from those of the first embodiment will be described, and the same configurations as those of the first embodiment will not be repeated. FIG. 7 is diagram illustrating a waveform of a current which is caused to flow between an anode and a cathode in a method of forming a metal coating according to the second embodiment. In FIG. 7, a positive value of a current (current density) represents a value of the current when flowing from the anode to the cathode (substrate), and a negative value represents a value of the current when flowing from the cathode (substrate) to the anode.

In the second embodiment, during coating formation, the current-flowing period T is shifted to the non-current-flowing period N after the power supply causes a pulse current (current corresponding to one pulse) to flow from the substrate (cathode) B to the anode 11 in a current-flowing period R which is shorter than the current-flowing period T.

In the second embodiment, when the current-flowing period T is shifted to the non-current-flowing period N, the falling time of a potential (that is, a flowing current) of the anode in a case where the pulse current illustrated in FIG. 6 is used can be further reduced, and the potential of the anode (flowing current) can be made to rapidly fall.

In this way, a current can be made to rapidly fall in the current-flowing period T, and thus the diffusion of the metal ions in the solid electrolyte membrane 13 to the cathode-side portion can be rapidly inhibited. In addition, due to the falling time being reduced, the pulse period can be reduced, and the coating-forming rate can be further improved.

Further, since a current is caused to flow from the substrate B to the anode 11, metal on the surface of the metal coating is dissolved as metal ions. Accordingly, impurities which are likely to be incorporated into the surface of the metal coating immediately after the finish of the current-flowing period can be reduced in the surface of the metal coating.

In the methods according to the above-described first and second embodiments, the maximum current density of the current waveform, the current-flowing period, and the non-current-flowing period may vary depending on the kind of metal to be deposited, the metal solution to be used, the temperature during coating formation, and the like.

The invention will be described using the following examples.

EXAMPLE 1

<Preparation of Nickel Solution>

24.9 ml of a 2.0 mol/L acetic acid-sodium acetate buffer solution was added to 58.4 mL of a 1.71 mol/L nickel sulfate ion solution, followed by stirring. Next, 15.3 mL of water was added to this solution, followed by stirring. Further, an 10 mol/L aqueous sodium hydroxide solution was added dropwise to adjust the pH of the nickel solution to 5.6. Further, water was added the nickel solution with the adjusted pH such that the total amount was 100 mL.

<Formation of Nickel Coating>

Figure 8A:
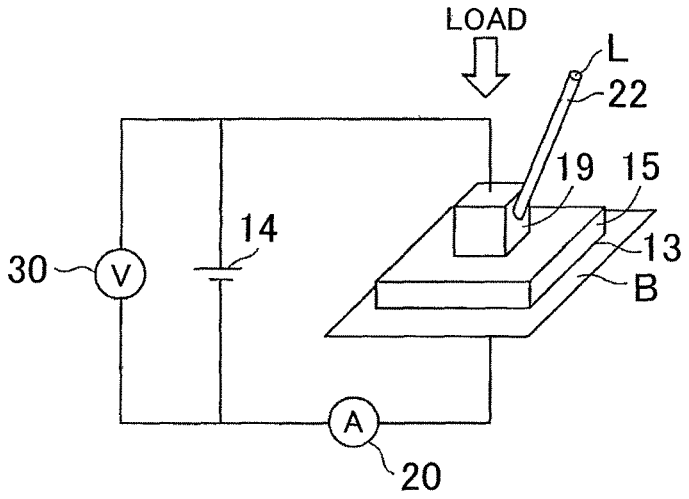
FIGS. 8A and 8B are schematic diagrams illustrating a device for forming metal coatings according to Examples 1 and 2 and Comparative Examples 1 and 2.
Figure 8B:
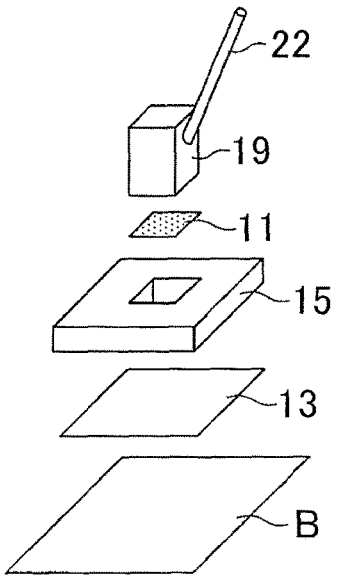

A nickel coating was formed using a coating forming device illustrated in FIGS. 8A and 8B. Among components of the coating forming device illustrated in FIGS. 8A and 8B and components of the coating forming device, illustrated in FIGS. 1 and 2, components represented by the same reference numerals have the same functions.

First, a pure aluminum substrate. (50 mm×50 mm×thickness 1 mm) was prepared as the substrate B having a surface for forming a metal coating, a nickel plated coating was formed on the surface of the pure aluminum substrate, and a gold plated coating was formed on a surface of the nickel plated coating, followed by washing with flowing pure water.

Next, on a surface of a porous body (manufactured by Mitsubishi Materials Corporation) formed of a titanium foam (10 mm×10 mm×1 mm) and having a porosity of 65 vol %, a platinum coating having a thickness of 3 μm was formed on a plating surface thereof corresponding to the coating-forming region to prepare an electrode. This electrode was used as the anode 11. As the solid electrolyte membrane 13, an electrolyte membrane (manufactured by DuPont; NATION N117) having a thickness of 173 μm was used.

A glass jig as the metal ion supply portion 15, the anode 11, the solid electrolyte membrane 13, and the contact pressurization portion 19 were set as illustrated in FIG. 8B, and a load of 5 kgf/cm$^2$ was applied to the contact pressurization portion 19. Next, the nickel solution (metal solution L) was supplied to the anode 11 from the supply pipe 22 to supply nickel ions to the solid electrolyte membrane 13. The nickel solution was supplied to a gap between the metal ion supply portion 15 (glass jig) and the contact pressurization portion 19 such that more than 1 mL of the nickel solution was present in the gap.

Figure 9A:
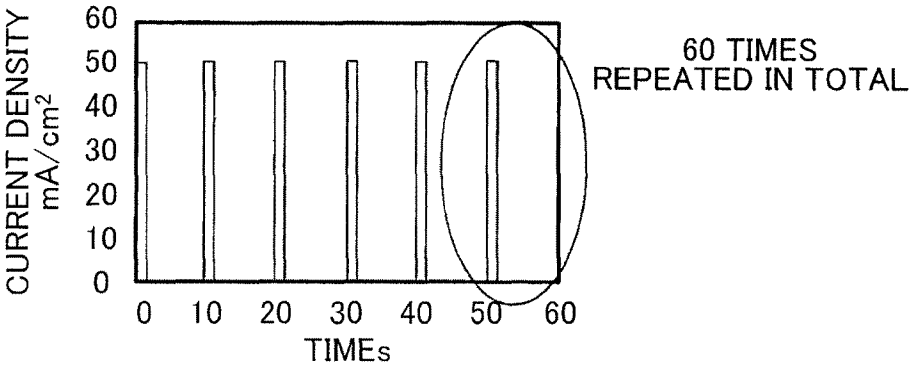
FIG. 9A is a diagram illustrating a waveform of a flowing current according to Example 1.

As illustrated in FIG. 9A, the power supply 14 caused the pulse current according to the first embodiment to flow from the anode 11 to the substrate B forming the cathode while checking an ammeter 20 and a voltmeter 30. Specifically, a current-flowing period of 50 mA/cm$^2$ and 1 second and a non-current-flowing period of 9 seconds were set as one cycle, and 60 cycles were repeated. In Example 1, the average current density was 5 mA/cm$^2$, and the cumulative current amount was 3A·sec. In FIGS. 9A to 9D, a positive value of a current density represents a value of the current when flowing from the anode to the cathode (substrate), and a negative value represents a value of the current when flowing from the cathode (substrate) to the anode.

EXAMPLE 2

Figure 9B:
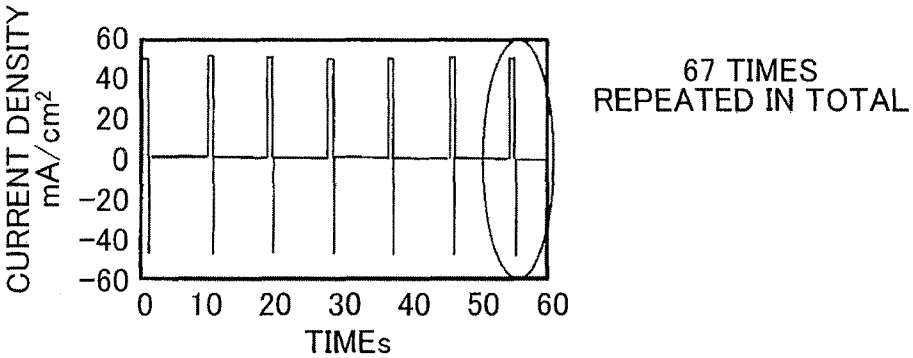
FIG. 9B is a diagram illustrating a waveform of a flowing current according to Example 2.

A nickel coating was formed with the same method as that of Example 1. Example 2 was different from Example 1, in that, as illustrated in FIG. 9B, the power supply 14 caused the pulse current according to the second embodiment to flow from the anode 11 to the substrate B forming the cathode. Specifically, a current-flowing period of 50 mA/cm$^2$ and 1 second, a current-flowing period of −50 mA/cm$^2$ and 0.1 second, and a non-current-flowing period of 7.9 seconds were set as one cycle, and 67 cycles were repeated. In Example 2, the average current density was 5 mA/cm$^2$, and the cumulative current amount was 3A·sec.

COMPARATIVE EXAMPLE 1

Figure 9C:
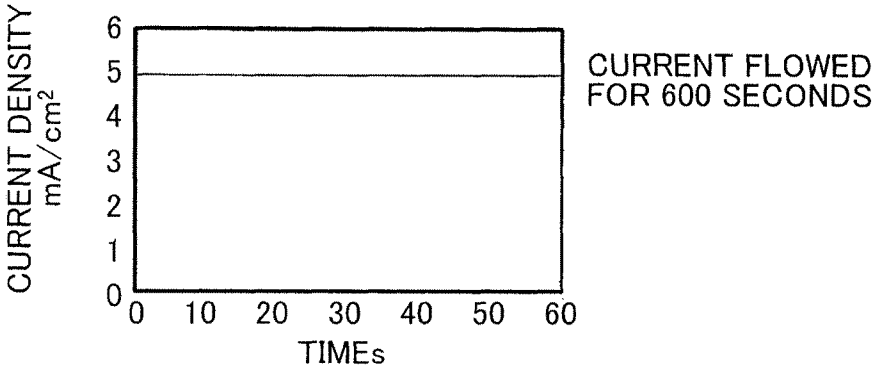
FIG. 9C is a diagram illustrating a waveform of a flowing current according to Comparative Example 1.

A nickel coating was formed with the same method as that of Example 1. Comparative Example 1 was different from Example 1, in that, as illustrated in FIG. 9C, the power supply 14 caused a current of 5 mA/cm$^2$ to continuously flow from the anode 11 to the substrate B forming the cathode for 600 seconds. In Comparative Example 1, the average current density was 5 mA/cm$^2$, and the cumulative current amount was 3A·sec.

COMPARATIVE EXAMPLE 2

Figure 9D:
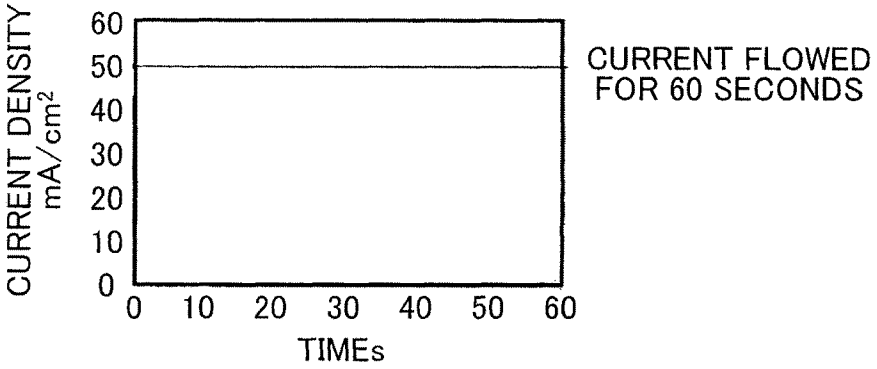
FIG. 9D is a diagram illustrating a waveform of a flowing current according to Comparative Example 2.
Figure 10A:
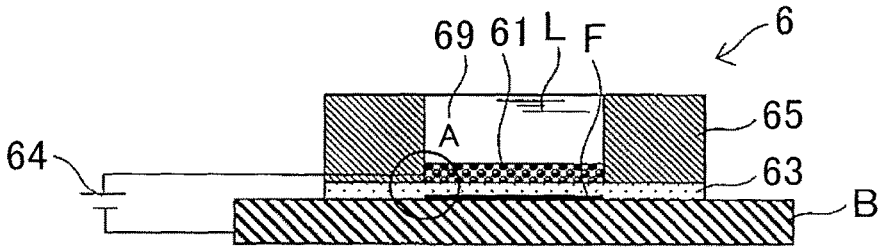
FIG. 10A RELATED ART
FIG. 10A is a diagram illustrating a method of forming a metal coating in the related art.
Figure 10B:
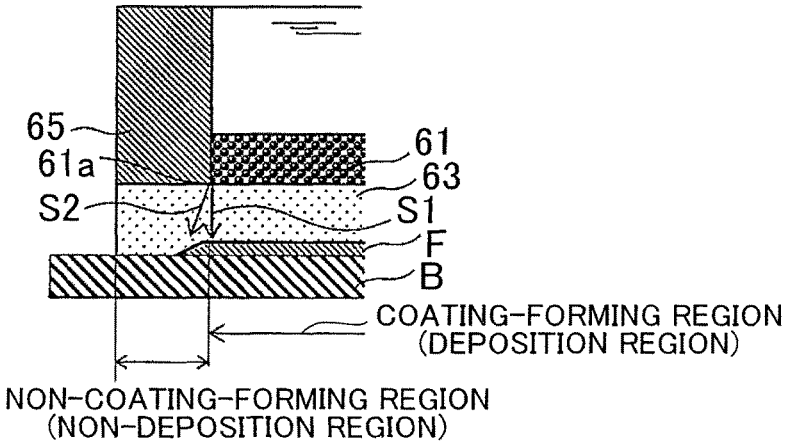
FIG. 10B RELATED ART
FIG. 10B is an enlarged view illustrating portion A of FIG. 10A.
Figure 10C:
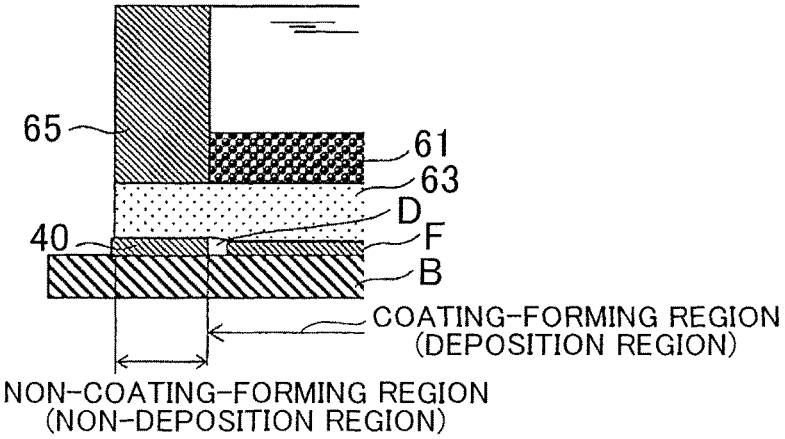
FIG. 10C RELATED ART
FIG. 10C is a diagram illustrating a method of forming a metal coating by masking and which corresponds to FIG. 10B.

A nickel coating was formed with the same method as that of Example 1. Comparative Example 2 was different from Example 1, in that, as illustrated in FIG. 9D, the power supply 14 caused a current of 50 mA/cm$^2$ to continuously flow from the anode 11 to the substrate B forming the cathode for 60 seconds. In Comparative Example 2, the average current density was 50 mA/cm$^2$, and the cumulative current amount was 3A·sec.

<Observation of Coating>

The nickel coatings according to Examples 1 and 2 and Comparative Examples 1 and 2 were observed with a microscope in order to measure the protruding amount (length) thereof from the coating-forming region. The results are shown in Table 1.

<Decrease in Coating-Forming Rate>

The thicknesses of the nickel coatings according to Examples 1 and 2 and Comparative Examples 1 and 2 were measured in order to calculate the coating-forming rate from the thicknesses. A decrease in the coating-forming rate was calculated from the equation "1-Calculated Coating-Forming Rate/Theoretical Coating-Forming Rate×100". The results are shown in Table 1.

TABLE 1

| | Protruding Amount (μm) | Decrease in Coating-Forming Rate (%) |
|---|---|---|
| Example 1 | 23 | 2.3 |
| Example 2 | 8 | 0.8 |
| Comparative Example 1 | 160 | 14.5 |
| Comparative Example 2 | 107 | 10.0 |

<Result>

As clearly seen from Table 1, when the metal coatings were formed using the pulse currents according to Examples 1 and 2, the protruding amount decreased, and the pattern formability was improved, as compared to a case where the metal coatings were formed using the lower currents according to Comparative Examples 1 and 2. Due to the protruding amount decreasing, decreases in the coating-forming rates of Examples 1 and 2 were lower, that is, coating-forming rates thereof were higher than those of Comparative Examples 1 and 2.

Further, the protruding amount of Example 2. was less than that of Example 1. The reason is considered to be as follows. The current-flowing period was shifted to the non-current-flowing period after causing the pulse current to flow from the anode to the cathode in the subsequent current-flowing period which was shorter than the previous current-flowing period, and thus the metal ions moved to the cathode-side portion. In addition, since the falling time of the potential was reduced, the movement of the metal ions to the cathode-side portion during the falling period was suppressed.

Hereinabove, the embodiment of the invention has been described. However, the invention is not limited to the above-described embodiment, and various design modifications can be made thereto.

In the embodiment, the anode is formed of a porous body. However, the anode does not have to be formed of a porous body as long as it can suitably supply the metal ions to the solid electrolyte membrane.

The invention claimed is:

1. A method of forming a metal coating comprising:

disposing a solid electrolyte membrane between an anode and a substrate which forms a cathode;

bringing a solution containing metal ions into contact with an anode-side portion of the solid electrolyte membrane; and causing, in a state where the solid electrolyte membrane is in contact with the substrate, a current to flow from the anode to the cathode such that metal is deposited on a surface of the substrate from the metal ions contained in the solid electrolyte membrane to form the metal coating formed of the metal on the surface of the substrate, wherein the metal coating is formed by repeating a first current-flowing period in which a current flows from the anode to the cathode and a non-current-flowing period in which the current does not flow between the anode and the cathode, a current waveform including the first current-flowing period and the non-current-flowing period is formed of a rectangular current waveform, and the first current-flowing period is shifted to the non-current-flowing period after causing, in a second current-flowing period which is shorter than the first current-flowing period, the current to flow from the cathode to the anode, wherein the rectangular current waveform includes a rising time and a falling time, and wherein the non-current-flowing period is set to be longer than a total time which is a sum of a current-flowing period including the first current-flowing period and the second current-flowing period, the rising time, and the falling time.

* * * * *